United States Patent [19]

Nielsen

[11] Patent Number: 5,072,830

[45] Date of Patent: Dec. 17, 1991

[54] PROCESS FOR OBTAINING A PACKAGE CONTAINING MUTUALLY REACTIVE PARTICULATE MATERIALS

[75] Inventor: Kaj Nielsen, Tranbjerg, Denmark

[73] Assignee: Deltagraph A/S, Ringsted, Denmark

[21] Appl. No.: 538,699

[22] Filed: Jun. 18, 1990

Related U.S. Application Data

[63] Continuation of Ser. No. 127,058, Dec. 1, 1987, abandoned, which is a continuation of Ser. No. 843,598, Mar. 25, 1986, abandoned.

[30] Foreign Application Priority Data

Mar. 28, 1985 [DK] Denmark ..... 1406/85

[51] Int. Cl.[5] ..... B65D 81/32

[52] U.S. Cl. ..... 206/219; 53/434; 53/474; 206/524.8; 206/524.4

[58] Field of Search ..... 53/238, 402, 403, 405, 53/408, 434, 474, 432, 433, 450, 451, 464, 472; 206/219, 221, 316.1, 524.8, 524.4, 568, 578

[56] References Cited

U.S. PATENT DOCUMENTS

| | | | |
|---|---|---|---|
| 2,292,295 | 8/1942 | Royal | 53/434 |
| 2,380,903 | 7/1945 | Ray | 53/405 |
| 2,682,465 | 6/1954 | Wiitala et al. . | |
| 3,269,905 | 8/1966 | Damaskus et al. | 206/459 |
| 3,286,431 | 11/1966 | Sturm | 53/432 |
| 3,390,507 | 7/1968 | Repko | 53/450 X |
| 3,391,047 | 7/1968 | Kopp | 53/451 X |
| 3,419,134 | 12/1968 | Fitts | 53/472 X |
| 3,469,364 | 9/1969 | Bischoff | 53/434 |
| 3,608,709 | 9/1971 | Pike | 53/451 X |
| 4,081,560 | 3/1978 | Ishigaki . | |
| 4,289,233 | 9/1981 | Firth . | |
| 4,557,377 | 12/1985 | Maloney | 206/568 X |
| 4,608,043 | 8/1986 | Larkin | 206/219 X |
| 4,627,986 | 12/1986 | Bardsley et al. | 206/219 X |
| 4,632,244 | 12/1986 | Landau | 53/474 X |
| 4,651,875 | 3/1987 | Lang et al. | 206/568 X |
| 4,657,134 | 4/1987 | Woodworth et al. | 206/219 |
| 4,664,257 | 5/1987 | Nilson | 206/219 |
| 4,770,979 | 9/1988 | Koboshi et al. . | |

FOREIGN PATENT DOCUMENTS

| | | | |
|---|---|---|---|
| 646446 | 7/1964 | Belgium | 53/402 |
| 2029823 | 10/1970 | France . | |
| 103921 | 5/1964 | Norway | 53/405 |
| 6652 | of 1910 | United Kingdom . | |
| 967928 | 8/1964 | United Kingdom . | |
| 1352081 | 5/1974 | United Kingdom . | |

*Primary Examiner*—John Sipos

*Attorney, Agent, or Firm*—Watson, Cole, Grindle & Watson

[57] ABSTRACT

A process for obtaining a package containing at least two mutually reactive materials comprises the steps of introducing the reactive materials into an evelope suitable for vacuum packing, placing the reactive materials within the envelope in separate layers with at least one intervening separating layer of a material which is inert relative to the adjacent layer of a reactive material, evacuating and sealing the envelope.

12 Claims, No Drawings

PROCESS FOR OBTAINING A PACKAGE CONTAINING MUTUALLY REACTIVE PARTICULATE MATERIALS

This application is a continuation application of application Ser. No. 127,058, filed 12/1/87, now abandoned, which is a continuation Ser. No. 843,598, filed Mar. 25, 1986 now abandoned.

BACKGROUND OF THE INVENTION

This invention relates to the packaging of at least two mutually reactive particulate materials, and in particular two or more reactive materials for use in the development of exposed photographic films.

The development of exposed photographic films comprises the step of successively passing the films through developer and fixing baths consisting of aqueous solutions of substances which are solid at room temperature. During use, the efficiency of such baths gradually decreases and, therefore, fresh baths have to be prepared at certain intervals.

Some of the solid materials which are used for the preparation of such developer and fixing baths tend to react with one another to form undesired reaction products if they are brought into direct contact with one another. Therefore, they cannot be shipped to the user in the form of a mixture. Up to now it has been necessary to pack these substances or groups of substances in separate packages and to effect the mixing shortly before or in connection with the preparation of the baths. This has resulted in relative high packaging and transportation costs and also caused problems for the user who is to prepare the baths. Thus, the user has to take extra care that the correct materials are used in the correct proportions.

It has been attempted to avoid these problems by preparing concentrates of the desired solutions and to send these concentrates to the users, who then have to dilute the concentrates to make them suitable for use. This solution presents the serious disadvantage that a substantial amount of water has to be transported from the manufacturer to the user and that such concentrates cannot be sent as airfreight because the airline companies normally are unwilling to transport solutions of chemical compounds.

A further problem involved in the transportation of concentrates is that a precipitate which may be difficult to re-dissolve can be formed if the concentrate is cooled during such transport.

The object of the invention is to eliminate the problems discussed above.

SUMMARY OF THE INVENTION

The process of the invention is characterized in that it comprises the steps of introducing the reactive solid materials into an envelope suitable for vacuum packing, placing the reactive materials within the envelope in separate layers with at least one intervening layer of a material which is inert relative to the adjacent layer of reactive material, evacuating and sealing the envelope.

The invention is based on the discovery that the particles of a vacuum-packed solid material do not move substantially relative to one another, even if the package is subjected to rough handling and that two materials forming two separate layers in such in a vacuum package can be prevented from contacting one another by providing one or more separating layers between the layers of these materials.

In addition to the above mentioned advantages the process of the invention presents the advantages which are obtained by conventional vacuum-packaging, viz. that atmospheric oxygen and moisture are excluded.

An additional advantage is that the volume of the packed materials is as small as possible, which is particularly significant as far as transportation costs are concerned.

The term "inert" used herein means that the materials when physically contacted with one another do not react under the conditions prevailing in the package or that any reaction is insignificant.

The inert material may be a substance which, apart from being inert relative to the two mutually reactive, is inactive as far as the intended use of the two active materials is concerned, yet can also be a substance which has to be used simultaneously with the two reactive materials.

A typical developer bath is prepared from a developer substance, such as hydroquinone; sodium sulfite; borax; a strong base, such as sodium hydroxide; potassium bromide and one or more additives. Hydroquinone and sodium hydroxide react with one another in solid state and should consequently not be in direct contact during transportation and storage prior to the preparation of the developer bath. However, by providing in a vacuum package a layer of sodium sulfite and borax as a separating layer between a layer of hydroquinone and a layer of sodium hydroxide, these materials can be stored in the same package for long periods of time without any adverse effect on the developer bath subsequently prepared from said materials.

The vacuum-packaging of the two mutually reactive substances and the intervening material or materials can be effected in a conventional manner. However, it is preferred to use separate means for successively supplying the materials to the envelope.

The envelopes used are preferably bags prepared from an inactive, air-tight plastic film or a laminate of a plastic material and a metal foil.

The invention also relates to a package comprising a sealed envelope comprising separate layers of at least two mutually reactive materials separated by at least one layer of a material which is inert relative to the material of the adjacent layer, the pressure within the envelope being subatmospheric.

The invention will now be described in further detail with reference to the following example:

EXAMPLE

The following substances were introduced into a bag consisting of an aluminium foil coated with a plastic material and each substance was caused to form a layer on top of the substance previously introduced into the bag:

| | |
|---|---|
| Ethylene diamine tetraacetic acid | 20 g |
| Hydroquinone | 312 g |
| 1-Phenyl-3-pyrazolidone | 8 g |
| Sodium sulfite | 1250 g |
| Potassium bromide | 75 g |
| Borax | 312 g |
| Sodium hydroxide | 168 g |
| Total | 2145 g. |

Subsequently, the bag was evacuated and sealed in a conventional manner. The bag was stored for 1½ months and was then opened and the contents dissolved in water. During use of the developer bath thus obtained it was found that its properties were similar to those of a freshly prepared developer bath.

I claim:

1. A process for packaging solid particulate photographic materials used in the development of exposed photographic films comprising the steps of:

(a) providing an envelope suitable for vacuum packaging which defines a single chamber therein, (b) providing at least three solid particulate photographic materials, at least two of which are mutually reactive and at least one of which is inert relative to said two which are mutually reactive, (c) separately introducing said solid particulate photographic materials into said single chamber in said envelope such that solid photographic materials which are mutually reactive are placed in separate layers within said envelope and are separated by at least one intervening layer of solid particulate material which is inert relative to each adjacent layer of said materials while within the envelope, (d) evacuating said envelope of air, and (e) sealing said evacuated envelope, thereby immobilizing said layers of solid particulate materials relative to one another.

2. The process of claim 1, wherein said envelope is made of a plastic film.

3. The process of claim 1, wherein said envelope is made of a laminate of a plastic material and an aluminium foil.

4. The process of claim 1, wherein said photographic materials are employed in a photographic developer bath.

5. The process of claim 4, wherein said mutually reactive materials are hydroquinone and a strong base.

6. The process of claim 5, wherein said intervening layer of a relatively inert material comprises sodium sulfite and borax.

7. The process of claim 1, wherein the layers of solid particulate materials are introduced and separated into layers as follows:

Ethylene diamine tetracetic acid
Hydroquinone
1-Phenyl-3-pyrazolidone
Sodium sulfite
Potassium bromide
Borax
Sodium hydroxide.

8. A package of solid particulate photographic materials for use in the development of exposed photographic films which includes a sealed, evacuated envelope that defines a single chamber and at least three immobilized layers of solid particulate photographic materials contained in said envelope, at least two of said materials being mutually reactive and at least one of said materials being inert relative to said two which are mutually reactive, said layers of said at least two mutually reactive materials being separated by at least one intervening layer of said inert material, said package being made by the steps of:

(a) providing an envelope suitable for vacuum packaging which defines a single chamber therein, (b) providing at least three solid particulate photographic materials, at least two of which are mutually reactive and at least one of which is inert relative to said two which are mutually reactive, (c) separately introducing said solid particulate photographic materials into said single chamber in said envelope such that solid photographic materials which are mutually reactive are placed in separate layers within said envelope and are separated by at least one intervening layer of solid particulate material which is inert relative to each adjacent layer of said materials while within the envelope, (d) evacuating said envelope of air, and (e) sealing said evacuated envelope, thereby immobilizing said layers of solid particulate materials relative to one another.

9. The package as defined in claim 8, wherein said envelope is made of a plastic film.

10. The package as defined in claim 8, wherein said envelope is made of a laminate of a plastic material and an aluminium foil.

11. The package as defined in claim 8, wherein said mutually reactive materials are hydroquinone and a strong base.

12. The package as defined in claim 8, wherein said intervening layer of a relatively inert material comprises sodium sulfite and borax.

* * * * *